US006828745B1

(12) United States Patent
Valente et al.

(10) Patent No.: US 6,828,745 B1
(45) **Date of Patent: *Dec. 7, 2004**

(54) METHOD AND APPARATUS FOR PROGRAMMING A LOGIC BOARD FROM SWITCHING POWER

(75) Inventors: Christopher M. Valente, Lombard, IL (US); James J. Fitzgibbon, Batavia, IL (US); Ramon Tam, Chicago, IL (US); Mark Siegler, Aurora, IL (US); Martin Rathgeber, Chicago, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/505,240

(22) Filed: Feb. 16, 2000

Related U.S. Application Data

(63) Continuation-in-part of application No. 09/252,044, filed on Feb. 17, 1999, now Pat. No. 6,078,159.

(51) Int. Cl.[7] ..... E05F 15/10
(52) U.S. Cl. ..... 318/468; 318/568.1
(58) Field of Search ..... 318/264, 265, 318/266, 286, 466, 467, 468, 567, 568.1; 340/310.01, 310.02

(56) References Cited

U.S. PATENT DOCUMENTS

| | | | | |
|---|---|---|---|---|
| 4,349,748 A | | 9/1982 | Goldstein et al. | 307/132 E |
| 4,386,436 A | | 5/1983 | Kocher et al. | 455/151 |
| 4,465,956 A | | 8/1984 | Fowler | 318/268 |
| 4,649,323 A | | 3/1987 | Pearlman et al. | 315/307 |
| 4,668,878 A | | 5/1987 | Wyss | 307/141 |
| 4,672,232 A | | 6/1987 | Schoen | 307/140 |
| 4,695,739 A | | 9/1987 | Pierce | 307/141 |
| 4,716,409 A | | 12/1987 | Hart et al. | 340/825.22 |
| 4,825,200 A | | 4/1989 | Evans et al. | 341/23 |
| 4,847,542 A | * | 7/1989 | Clark et al. | 218/560 |
| 4,896,083 A | | 1/1990 | Kopala et al. | 318/268 |
| 5,189,412 A | | 2/1993 | Mehta et al. | 340/825.22 |
| 5,278,480 A | | 1/1994 | Murray | 318/626 |
| 5,481,452 A | | 1/1996 | Simmons | 364/141 |
| 5,751,224 A | | 5/1998 | Fitzgibbon | 340/825.72 |
| 5,753,983 A | | 5/1998 | Dickie et al. | 307/141.4 |

* cited by examiner

*Primary Examiner*—Bentsu Ro
(74) *Attorney, Agent, or Firm*—Fitch, Even, Tabin & Flannery

(57) ABSTRACT

A method of programming a controller for a movable barrier operator includes enabling and disabling an input device within a predetermined period of time, a predetermined number of times. This sequence of short activations of an input device, such as a switch on a wall unit, puts the controller in a learn mode or a programmed state. Thereafter, the controller is responsive to learn any of the various routines that can be programmed for the movable barrier operator, such as transmitter code, limits of travel, force settings, and so on.

28 Claims, 13 Drawing Sheets

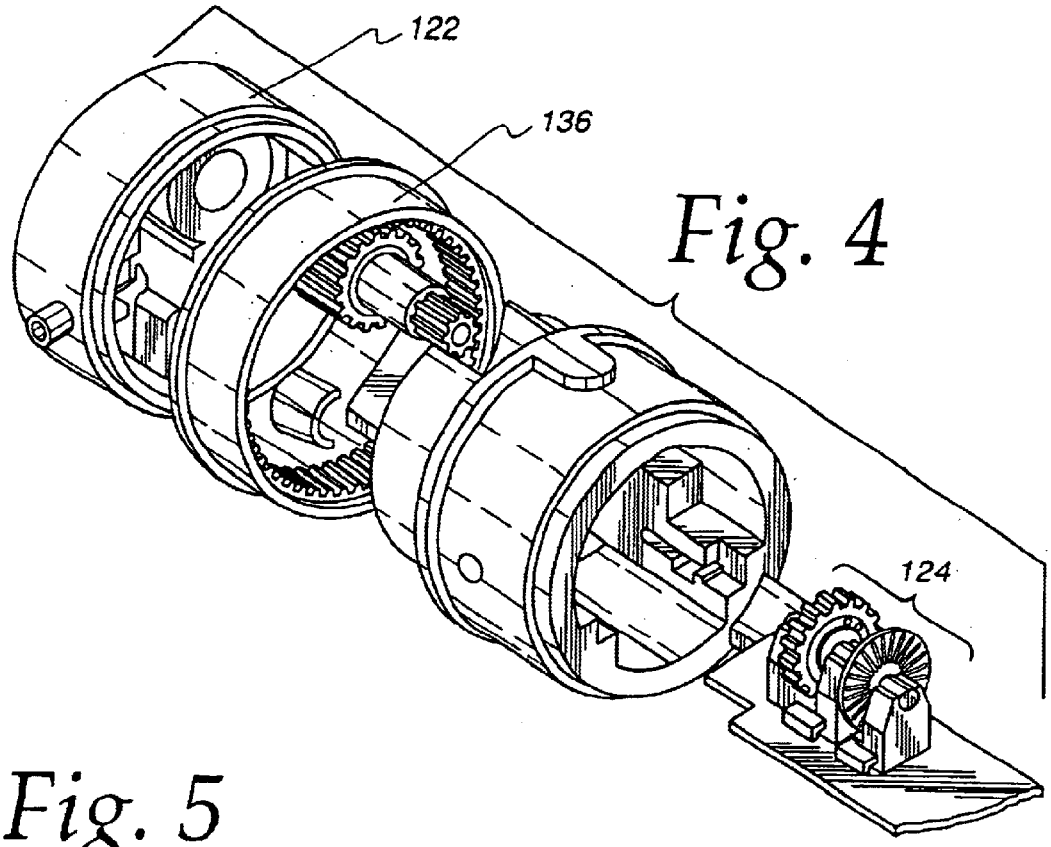
Fig. 4
Fig. 5
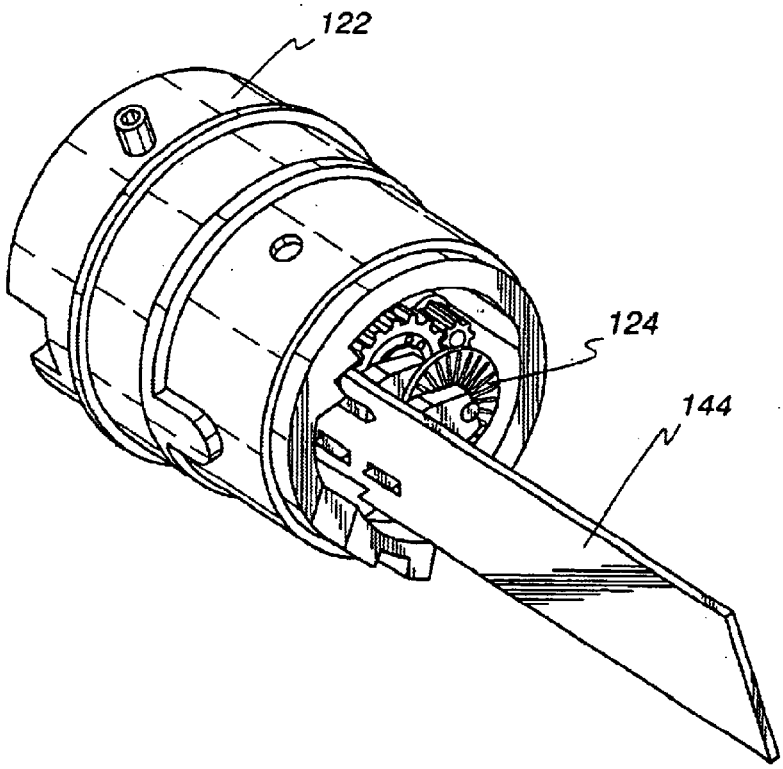

| | |
|---|---|
| Fig. 6A | Fig. 6B |
| Fig. 6C | Fig. 6D |

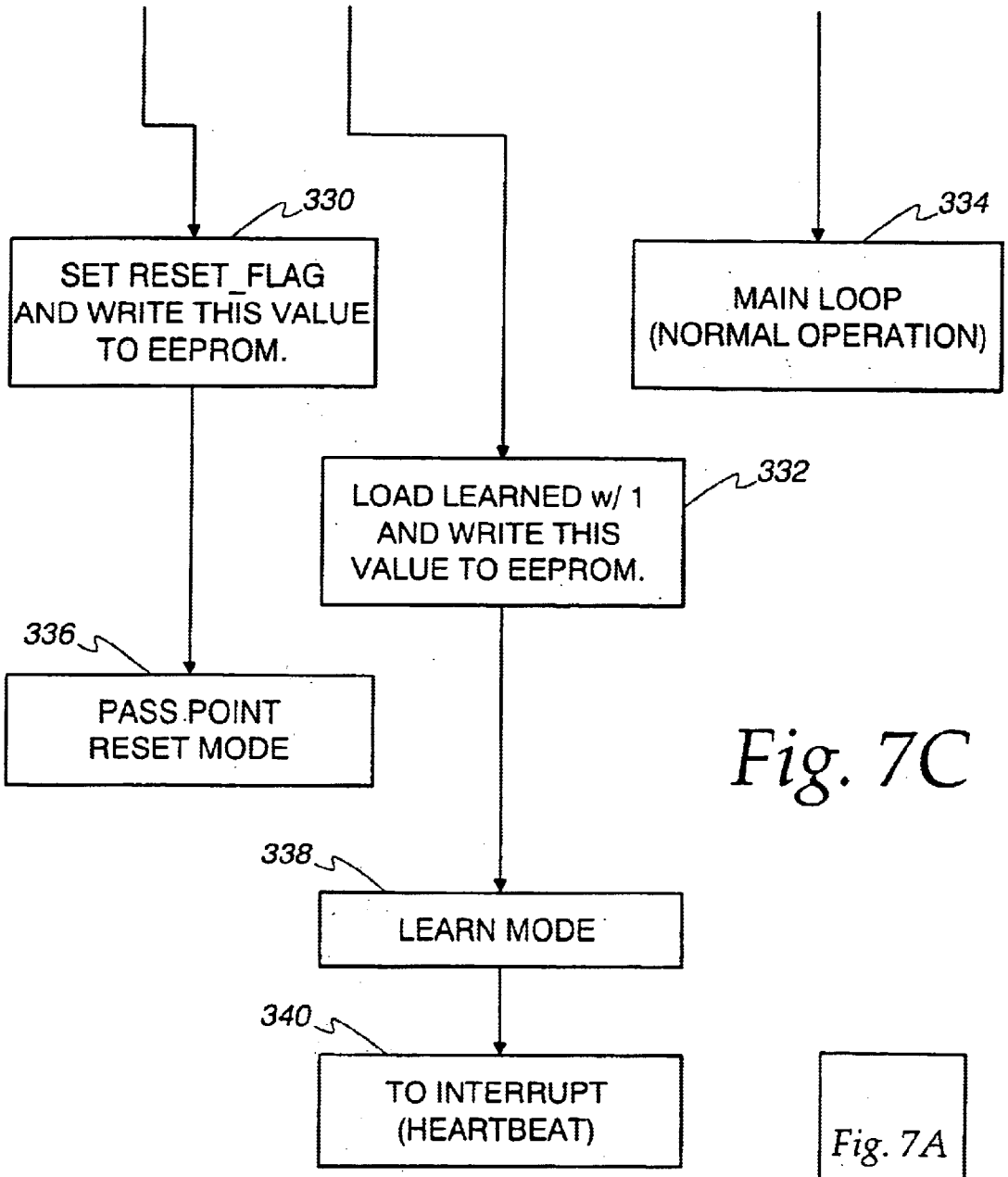
Fig. 7C
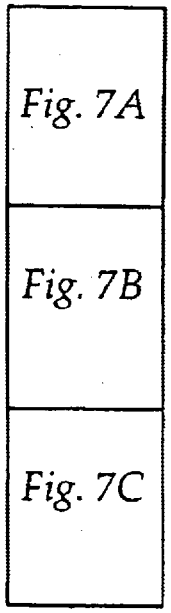

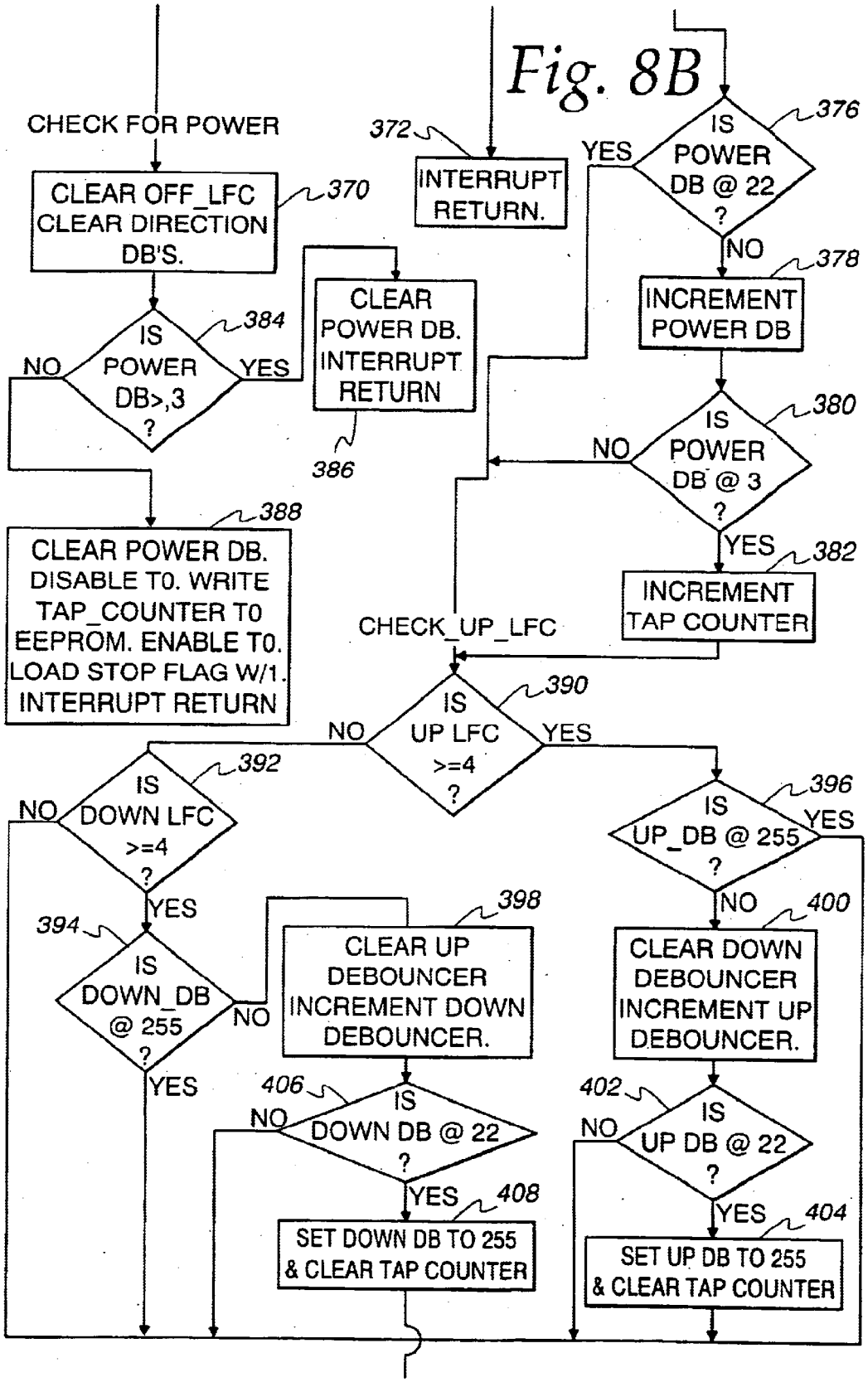
Fig. 8B
CHECK FOR POWER
CLEAR OFF_LFC CLEAR DIRECTION DB'S.
370
IS POWER DB>,3 ?
384
NO
YES
CLEAR POWER DB. INTERRUPT RETURN
386
372
INTERRUPT RETURN.
CLEAR POWER DB. DISABLE T0. WRITE TAP_COUNTER T0 EEPROM. ENABLE T0. LOAD STOP FLAG W/1. INTERRUPT RETURN
388
IS POWER DB @ 22 ?
376
YES
NO
INCREMENT POWER DB
378
IS POWER DB @ 3 ?
380
NO
YES
INCREMENT TAP COUNTER
382
CHECK_UP_LFC
IS UP LFC >=4 ?
390
NO
YES
IS DOWN LFC >=4 ?
392
NO
YES
IS DOWN_DB @ 255 ?
394
NO
YES
CLEAR UP DEBOUNCER INCREMENT DOWN DEBOUNCER.
398
IS DOWN DB @ 22 ?
406
NO
YES
SET DOWN DB TO 255 & CLEAR TAP COUNTER
408
IS UP_DB @ 255 ?
396
YES
NO
CLEAR DOWN DEBOUNCER INCREMENT UP DEBOUNCER.
400
IS UP DB @ 22 ?
402
NO
YES
SET UP DB TO 255 & CLEAR TAP COUNTER
404

METHOD AND APPARATUS FOR PROGRAMMING A LOGIC BOARD FROM SWITCHING POWER

This is a continuation-in-part of prior application Ser. No. 09/252,044, filed Feb. 17, 1999, now U.S. Pat. No. 6,078,159, which is hereby incorporated herein by reference in its entirety.

A computer program listing appendix submitted to the United States Patent and Trademark Office on a Compact Disk named ExhibitA(Scanned Image).pdf in duplicate is incorporated herewith by reference.

BACKGROUND OF THE INVENTION

This invention relates to a method and apparatus for programming and controlling a logic board for an electromechanical device such as a movable barrier operator using a two input command unit.

Many electromechanical devices, such as garage door operators and rolling shutter operators, employ simple wall or transmitter command units having only two types of input (open and close). Control of the operator is provided on a logic board, a board which contains the electronic circuitry (including a controller) for controlling operation of the motor driving the movable barrier. In a garage door operator or rolling shutter operator, commands are provided for open and close. Upon receipt of an open or close command, the controller enables the motor for movement in the commanded direction. In a garage door operator, a simple, momentary press of an open button or switch commands the door to move to the open limit position. In a rolling shutter operator, the user must press the open button or switch while the shutter is moving and release the button or switch when the shutter reaches the desired open position.

Many older garage door installations and rolling shutter installations are controlled by wall units having only open and close switches, which are hardwired into the wall. Newer garage door operators and rolling shutter operators provide additional features and include programming through either the wall switch or the remote transmitter. For example, many operators respond to transmitters with unique identification codes, provided the identification codes are programmed into the controller memory. To program a new transmitter, the user must typically press a learn switch which places the controller in the learn mode, then activate the transmitter so that the controller receives the unique identification code. Many such units require a separate learn switch on the wall unit. If a user wishes to upgrade to a more advanced garage door operator or rolling shutter operator, i.e., one with additional functionality, the user many not wish to spend the additional cost of having to tear out existing wiring.

In order to change the mode of a logic board (or controller), most systems require the microprocessor to receive an input in the form of a signal. Since some logic boards only have power when the switch is closed (as is the case in rolling shutter operators), there is no power to the board after release of the switch. This creates a problem for entering the program or learn mode when there is no power applied to the logic board. A system which enables the user to enter the program or learn mode by using the AC power lines solves the problem of having to provide additional components or wiring to the board in order to sustain power just for the unit to be able to enter the program or learn mode.

Several manufacturers of rolling shutter operators and garage door operators provide units which can be programmed from the wall unit. However, many of these units require non-retrofit of a special wall switch which operates on low voltage power, not standard AC wall power (such as those by Simu and Jolly). Another manufacturer provides a special wall control unit which operates on AC power, but is a nonstandard switch (Elero).

There is a need for a method of programming a logic board (or controller) for an electromechanical device such as a movable barrier operator using an existing two input command unit. There is a need for a method of programming a controller for an electromechanical device such as a rolling shutter operator or awning operator which operates from the existing standard industry two switch AC wall unit. There is a need for a method of programming an electromechanical device which generally has no power applied to it.

SUMMARY OF THE INVENTION

A method of programming a controller for a movable carrier operator according to the invention includes enabling and disabling an input device within a predetermined period of time for a predetermined number of times. This sequence of short activations of an input device, such as a switch on a wall unit, puts the controller in a learn mode. Thereafter, the controller is responsive to learn any of various characteristics that can be programmed for the movable barrier operator, such as transmitter code, limits of travel, force settings, and so on.

In a movable barrier operator, such as for a rolling shutter, the wall control unit includes two input devices, which may be switches, one for the shutter open direction and one for the shutter close direction. When the user wishes to open the shutter, the user presses the open switch. This causes AC power to be applied to the logic board controlling the power to the motor that operates the shutter. The user must hold the open switch until the shutter reaches the desired open location. Releasing the open switch removes AC power from the logic board and the motor and stops the shutter. Similarly, when the user desires to close the shutter, the user must press and hold the shutter close switch applying power to drive the motor to close the shutter until the desired close position is reached. Upon reaching the desired close position, the user releases the close button, removing AC power and stopping the motor.

Pressing of the open switch or the close switch is required to apply AC power to the controller. Continued closure of a switch is associated with movement of the motor and shutter. To enable programming of the controller using the wall switches, the controller checks for a series of pulses from one of the wall switches. When, for instance, the user presses and releases the open switch, five consecutive times each for less one half second, the controller increments a counter with each press. So long as the duration between press and release is less than a half second, the counter is incremented. When the counter value reaches five, the controller enters a learn mode. If at any time the user presses the switch for longer than one half second, the controller zeroes the counter and responds to a movement command.

In a movable barrier operator such as garage door opener in which the controller unit is powered at all times, the controller unit can also be programmed using the method of the invention. In the case of a garage door operator activated by a single button wall control unit, typically only a momentary activation (press and release) of the switch causes the door to travel to the selected limit (open or close). To implement the method of the invention, the controller for the garage door operator would be programmed to look for a fixed, but longer duration pulse resulting from switch closure for the movement command. For example, if five consecutive pulses produced by press and releases of less than one half second are used to enter the learn mode, a one second pulse from a press of one second could be used to clear the wall control command counter and activate door movement in the desired direction.

Instead of a standard two button wall control unit, some movable barriers have a single switch with three states: up, down, not traveling. The method described above is equally applicable. An advantage of the invention is that no additional wiring is needed for existing installations. All modifications are accomplished in the controller either in circuitry or software.

If the movable barrier operator includes a receiver for receiving commands from a remote transmitter, the method can also be used. Instead of activating the wall switch the predetermined number and duration of wall control pulses generated by presses and releases, the user would activate the transmitter button the same number and duration of time.

In many applications where the mode of the controller or logic board must be programmed by an external system, such as by pushing a button, through a software interface, or via a physical change in the surrounding environment, etc., programming the controller from AC power line eases the programming scheme for the user, the installer and the manufacturer.

In a further embodiment, the AC power line may also be used to transmit operation instructions to a movable barrier operator. For example, group control,of a plurality of rolling shutters may be achieved by using the controller or logic board of the rolling shutter unit to monitor the power line for, and receive, a series of binary digits generated by the activation and release of one of the wall control input switches. More particularly, the wall control input switch can be used to toggle the power line on and off to generate a series of binary ones and zeros, (e.g., power on is a binary one or high signal, and power off is a binary zero or low signal). Upon receipt of such a series of ones and zeros, the controller can decode the binary data and perform the function or operation attributed to such input. In order to limit the risk of accidental data reception, the controller can be designed so that only activations within a defined period of time that last for a duration of time less than the normal motor operation command will trigger the controllers performance of a particular function or operation. In order to achieve group control of a plurality of rolling shutters, the wall switch may be activated five times with each activation being within three hundred milliseconds of another, and the duration of the activation being below the half second of activation which causes the controller to operate the motor in a specified direction. The number of activations it takes to enter a particular mode of operation is not critical. For example, the learn mode may be entered upon seven activations of the input switch. In some instances, a uniform number of switch activations may be used to perform different operations. For instance, there may be no need to have the learn mode occur after five switch activations and the reset mode after nine switch activations. Therefore, the controller would both reset the movable barrier operator and enter a learn mode together after seven activations of the input switch.

Similarly, other embodiments of the invention would include entering the movable barrier operator into a lock mode after twenty activations of the input switch. Such a mode of operation would allow the user to lock movement of the movable barrier until the release mode is entered. The release mode can be entered by simply activating the input switch twenty more times. A memory clear mode could be entered by activating the input switch fifty times. Such a mode of operation would allow a user to clear all memory of such things as up limits and down limits in a rolling shutter.

Additional advantages and features of the invention may be appreciated from the written description set forth below and accompanying drawings.

BRIEF DESCRIPTION OF THE DRAWINGS

FIGS. 4 and 5 are two exploded perspective views of the location of the absolute position detector assembly shown in FIG. 3;

FIGS. 7A–7C are a flow chart of an overall routine for operating and controlling a movable barrier operator; and FIGS. 8A–8C are a flow chart of the timer interrupt routine called in the routine of FIG. 7.

DETAILED DESCRIPTION OF THE PREFERRED EMBODIMENT

Figure 1:
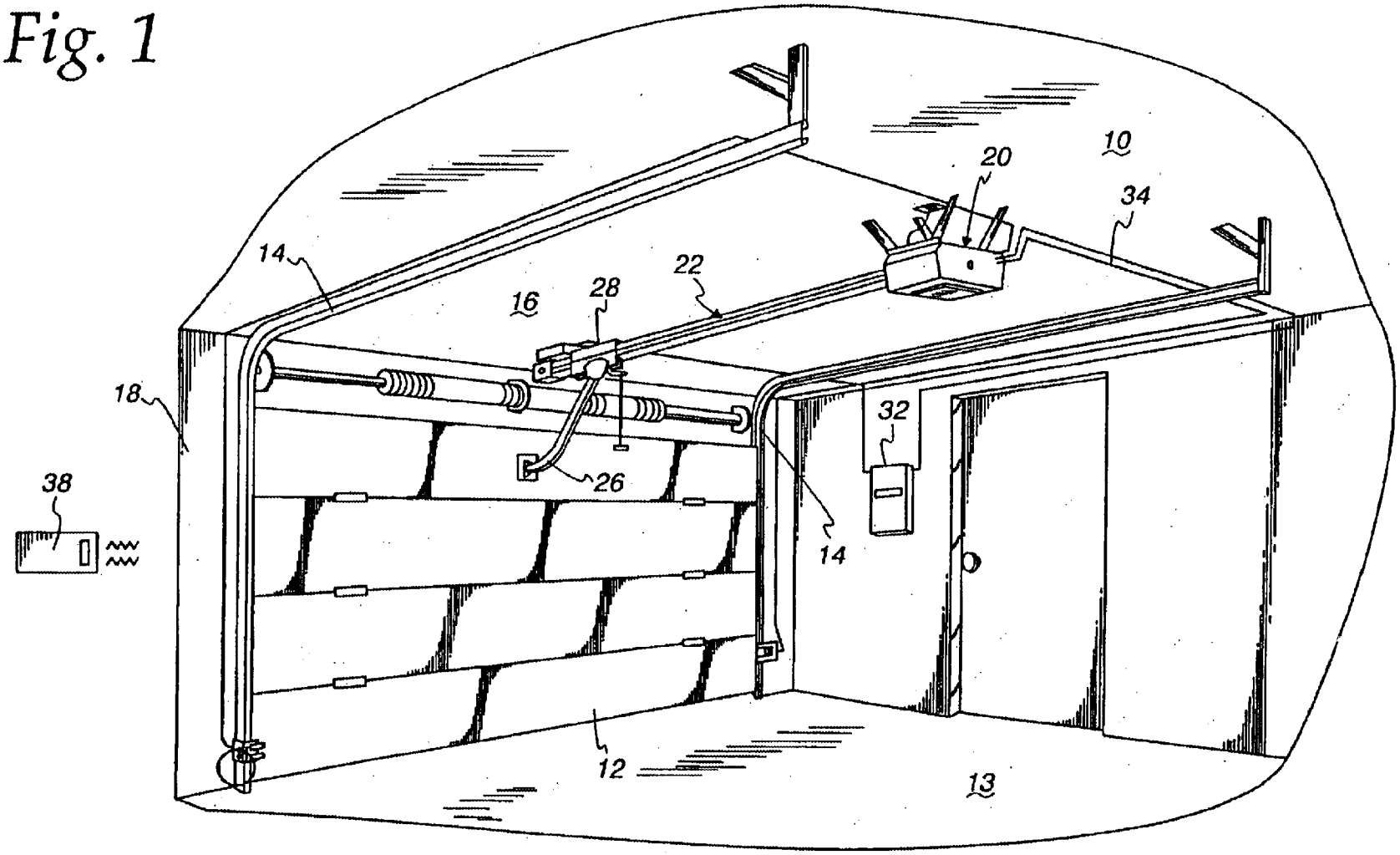
FIG. 1 is a perspective view of a garage door operating system in accordance with an embodiment of the invention.

Referring now to the drawings, and especially to FIG. 1, a movable barrier operator embodying the present invention is generally shown therein and identified by reference numeral 10. The movable barrier operator 10 is employed for controlling the opening and closing of a conventional overhead garage door 12 of a garage 13. The garage door 12 is mounted on guide rails 14 for movement between the closed position illustrated in FIG. 1 and an open or raised position. The garage 13 includes a ceiling 16 and a wall 18 defining an opening blocked by garage door 12. As shown, guide rails 14 are mounted to wall 18 and ceiling 16 of the garage 13 in a conventional manner.

A power drive unit or head, generally indicated at 20, is mounted to the ceiling 16 in a conventional manner. A drive rail 22 extends between the power drive unit 20 and the garage wall 18. As can be seen in FIG. 1, one end of the drive rail 22 is mounted to a portion of the garage wall 18 located above the garage door 12. An operator arm 26 is connected at one end to the garage door 12 and at the other end to a trolley 28 mounted for movement back and forth, along the drive rail 22. As will be seen herein, a motor in the power drive unit 20 propels the trolley 28 in a desired manner to raise and lower garage door 12 via the coupling of the trolley 28 and the operator arm 26 to the garage door 12.

A conventional one-button push button wall control unit 32, is coupled by electrical conductors 34 to the power drive unit 20 and sends signals to the power drive unit 20, controlling operation of a drive motor therein. Preferably, the power drive unit 20 also includes a conventional radio receiver (not shown) for receiving radio signals from a remote control transmitter 38.

Figure 2:
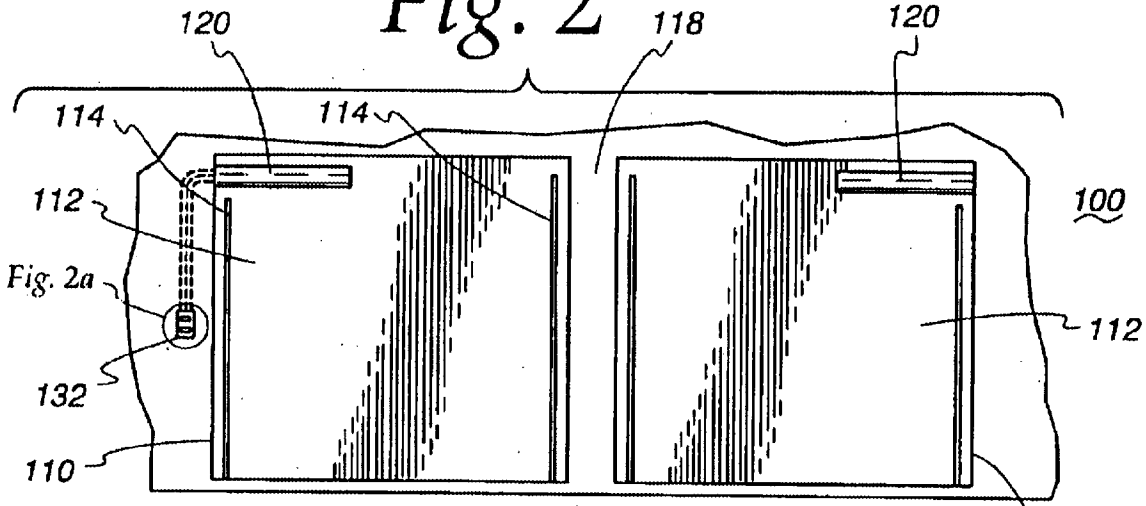
FIG. 2 is a perspective view of a rolling shutter operating system in accordance with an alternative embodiment of the invention.
Figure 2A:
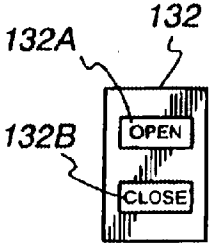
FIG. 2*a* is a perspective view of a wall control in accordance with an embodiment of the invention.

Referring now to FIG. 2, a barrier operator system 100 employing an absolute position detector is employed for controlling the opening and closing of a conventional rolling shutter 112. The rolling shutter is mounted on guide rails 114 for movement between the closed position illustrated in FIG. 2 and an open or raised position. The wall 118 defines an opening that can be blocked or covered by the rolling shutter 112. As shown, guide rails 114 are mounted to wall 118 in a conventional manner.

A power drive unit or head, generally indicated at 120, is mounted to the top of frame 110 in a conventional manner. Although the head unit is shown as being mounted on the exterior, as noted above, in many applications, the head unit is built into the wall so that the user sees only the shutter. In the two views shown in FIG. 2, the head unit 120 is shown mounted on opposite sides of the top of frame 110. As will be seen herein, a motor in head unit 120 propels a shutter carrying sleeve or tube 142 to raise and lower rolling shutter 112 via the connection of sleeve 142 to rolling shutter 112.

Control for head unit 120 may be as described above for garage door operator 20, i.e., using a push button wall control or a keypad mounted at another location on a wall. A conventional two button wall control unit 132 is connected via three wires: up, down, neutral (built into the wall and shown in dotted form) to head unit 120. Wall control 132 includes a shutter open button or switch 132A and a shutter close button 132B. Wall control 132 is connected to AC power and provides power to head unit 120 when one of buttons 132A or 132B is pressed and held. Additionally, head unit 120 may also include a conventional radio receiver (not shown) for receiving radio signals from a remote control transmitter. If desired, the head unit 120 may be mounted on either side of the frame 110. However, a conventional radio receiver requires power in order to receive a signal from a remote transmitter.

Figure 3:
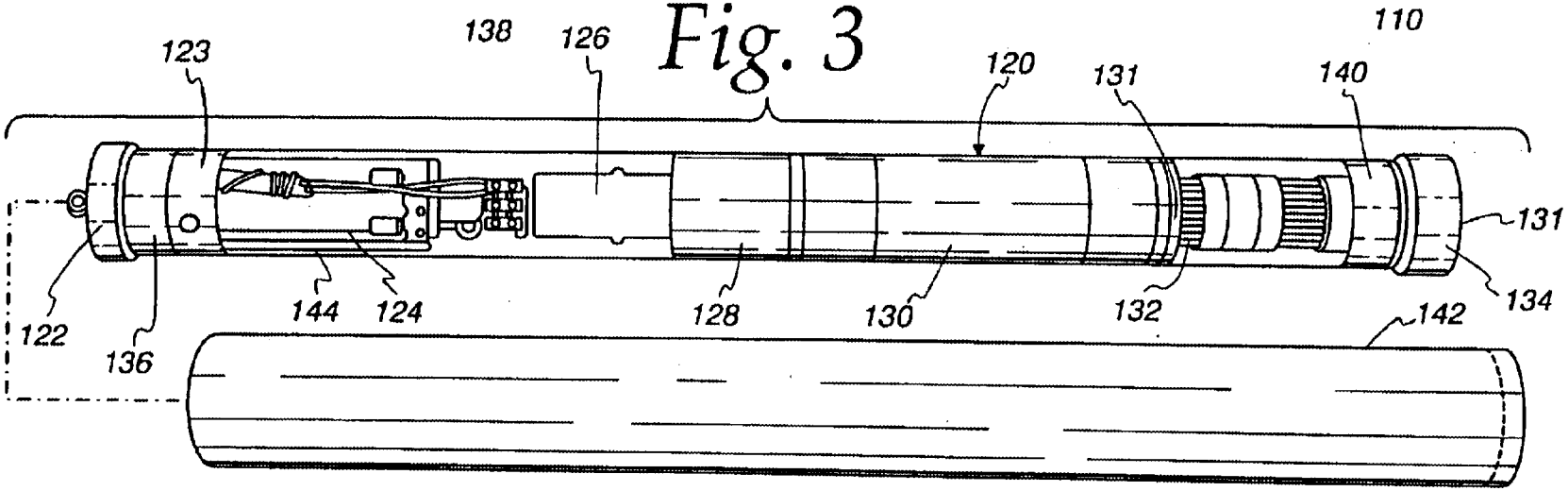
FIG. 3 is a perspective view of the tubular motor assembly of FIG. 2.
Figure 6A:
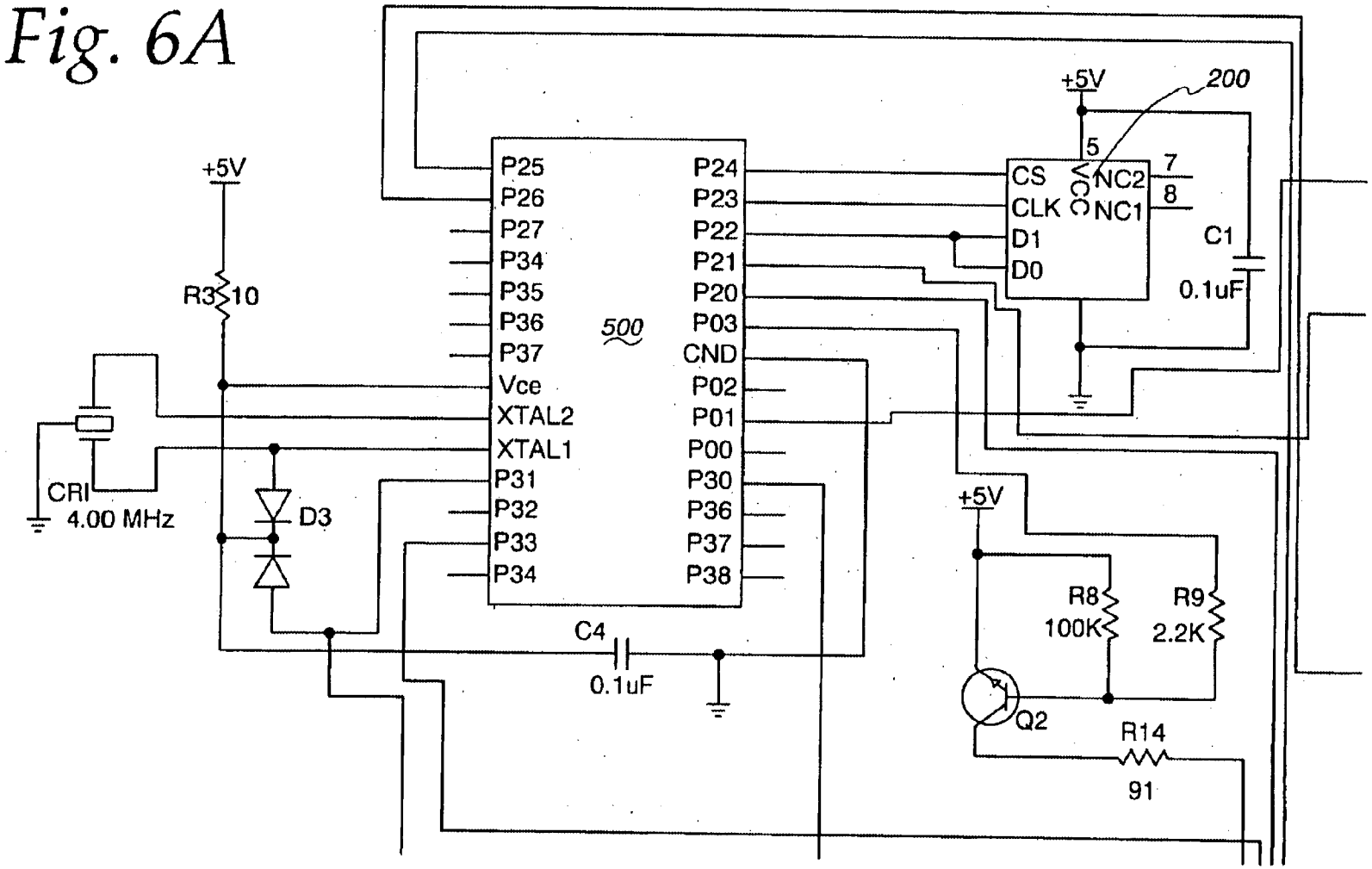
FIG. 6, which is represented herein as FIGS. 6A, 6B, 6C and 6D, is a schematic diagram of the electronics controlling the rolling shutter head unit of FIG. 2.
Figure 6B:
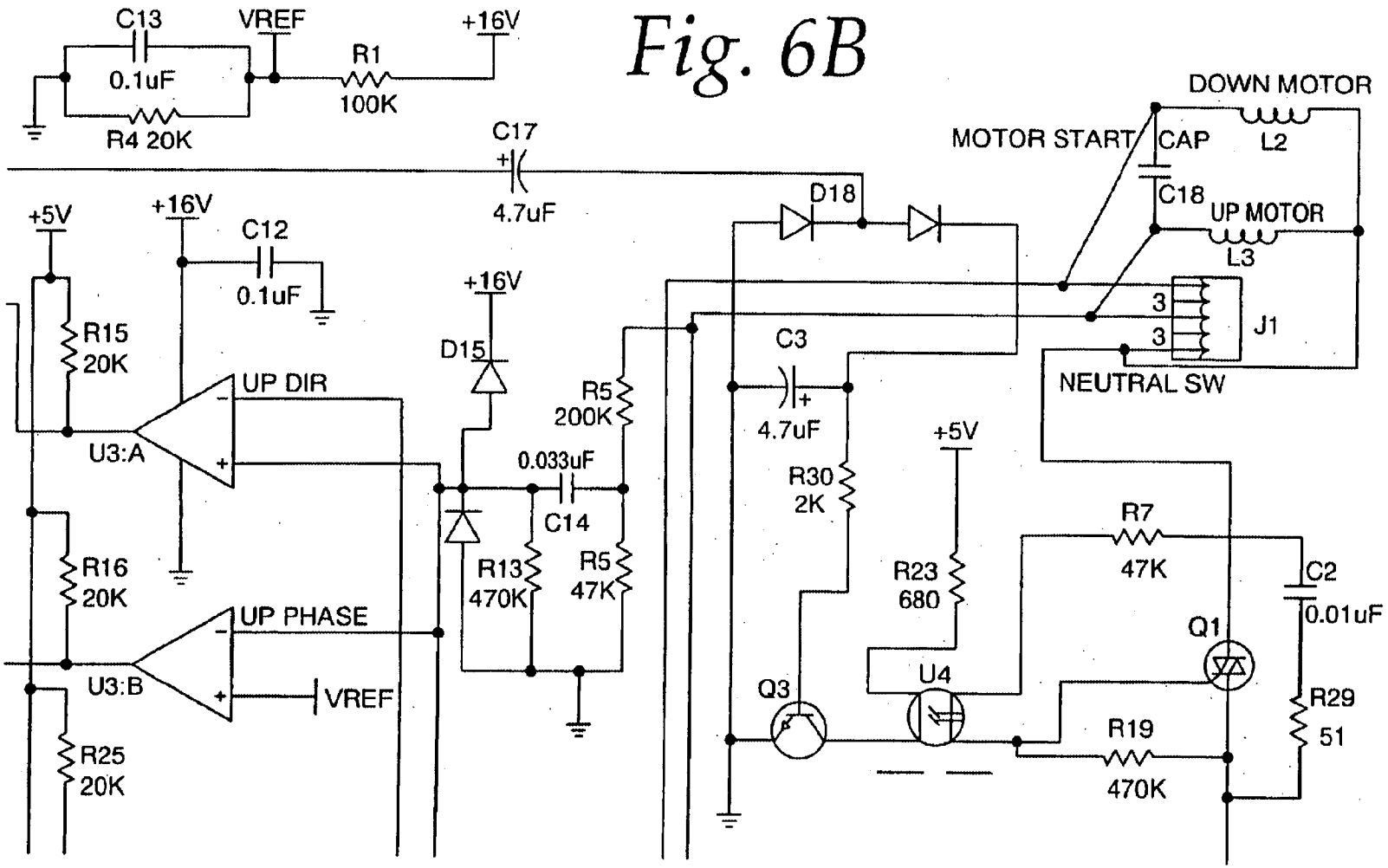
Figure 6C:
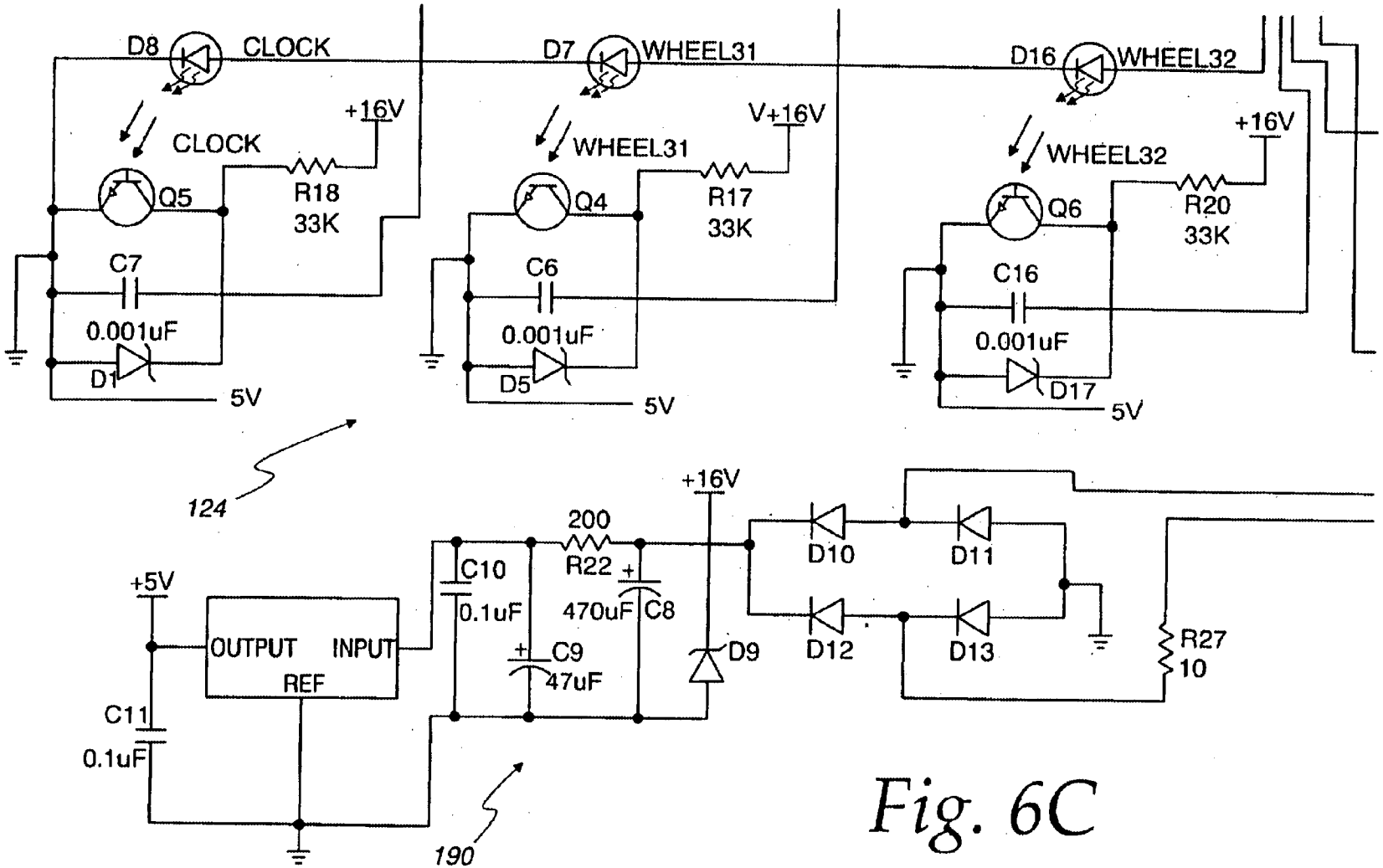
Figure 6D:
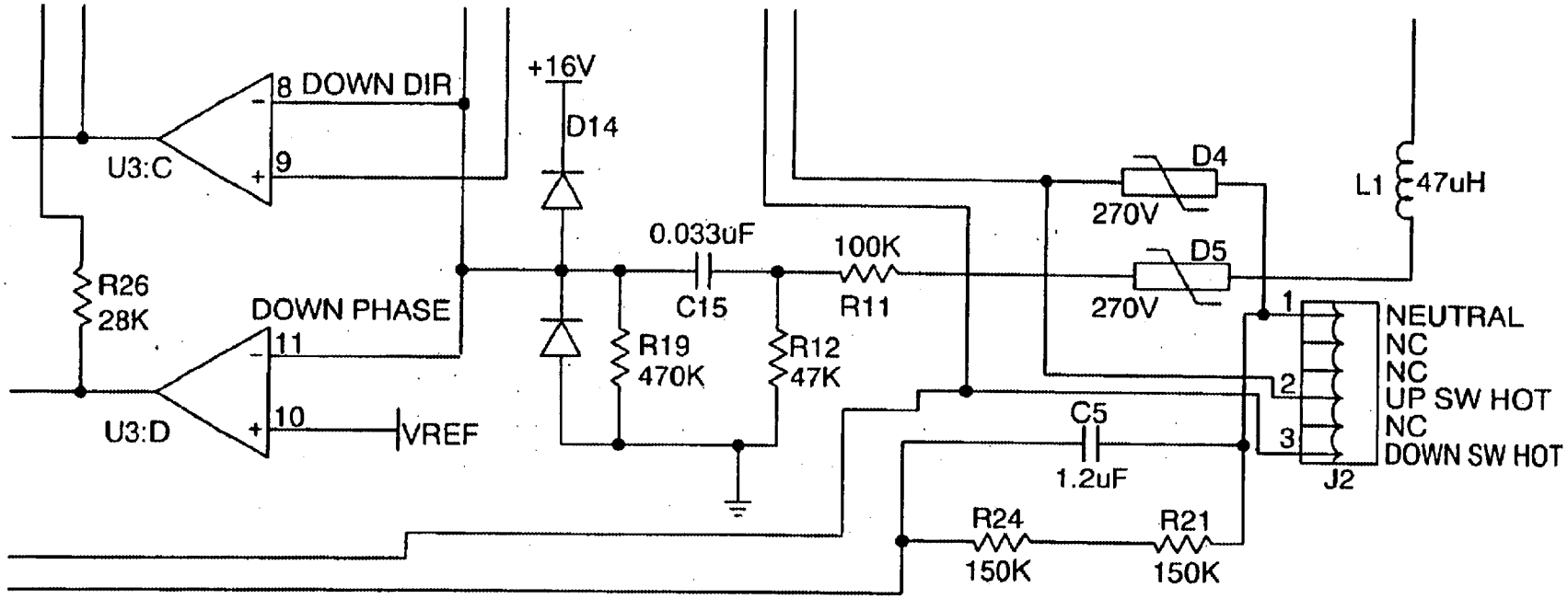

As shown in FIGS. 3, 4 and 5, head unit 120 includes a tubular housing 138 and end sections 122 and 134. Within the tubular housing 138 is the motor 130 which includes an output shaft 131 coupled at one end to end section 134 and at the other end to driving gear assembly 132. The output from gear assembly 132 is provided to an output ring 140, which is fixedly attached to outer sleeve 142. A rolling shutter is attached to the outer sleeve 142, so that when motor 130 runs, outer sleeve 142 rotates, causing the rolling shutter 120 to open or close (depending on the direction of rotation of motor 130).

Outer sleeve 142 is also fixedly attached to a ring 136. Ring 136 drives position detector assembly 124. Position detector assembly 124 is electrically coupled to a control board 144. Control board 144 contains the electronics for starting and controlling the motor 130 (see FIG. 6). A capacitor 126 is used to start motor 130 (described below). A brake 128 is provided to slow motor 130 when the rolling shutter is approaching a limit position. Position detector assembly 124 may be a pass point assembly as described in U.S. Pat. No. 6,133,703 assigned to the assignee of this application or an absolute position detector assembly as described in application Ser. No. 09/251,307, now abandoned.

A schematic of the control circuit located on control board 142 is shown in FIG. 6. A controller 500 operates the various software routines which operate the rolling shutter operator 120. Controller 500 may be a Zilog Z86733 microcontroller. In this particular embodiment, the rolling shutter is controlled only by a wall or unit mounted switch 132 coupled via a connector J2. Connector J2 has inputs for up switch hot and down switch hot signals. In a rolling shutter apparatus, the motor moves only when the user presses the combination power direction switch connected to connector J2. Pressing the up or down switch simultaneously applies power to the motor via connector J1 and provides various motor phase and direction information to the controller 500.

However, the control circuit can be modified to include a receiver so that the rolling shutter can be commanded from a remote transmitter (as described above). Power supply circuit 190 converts AC line power from connector J2 into plus 5 volts to energize the logic circuits and plus 16 volts to energize the motor.

Upon receipt of a rolling shutter movement command signal from either 132A or 132B through J2, the motor is activated. Upon receipt of programming or learn commands from either 132A or 132B (described below), controller 500 enters an appropriate learn routine. Feedback information from the motor and AC power is provided from J1 and applied to U3:A, U3:B, U3:C and U3:D. The outputs from U3:B and U3:D provide up and down phase information to pins P26 and P25 respectively. The outputs from U3:A and U3:C provide up and down direction to pins P21 and P20, respectively.

In this particular embodiment, an absolute position detector comprising three wheels: clock, wheel 31 and wheel 32 is shown in FIG. 6. Crystal CR1 provides an internal clock signal for the microprocessor 500. EEPROM 200 stores the bit stream data, sliding window information, current bit information and lookup table. The IR signal break from clock wheel drives Q5 which provides it input to P31. Wheel 31 drives Q4 which provides its input to P30. Wheel 32 drives Q3 which provides its input to P33. The inputs from the absolute position detector provide an absolute position of the shutter to the controller.

The preferred method of the invention will be described, for convenience, with reference to a rolling shutter controller, i.e., one which requires activation of the wall control switch for application of power.

Figure 7A:
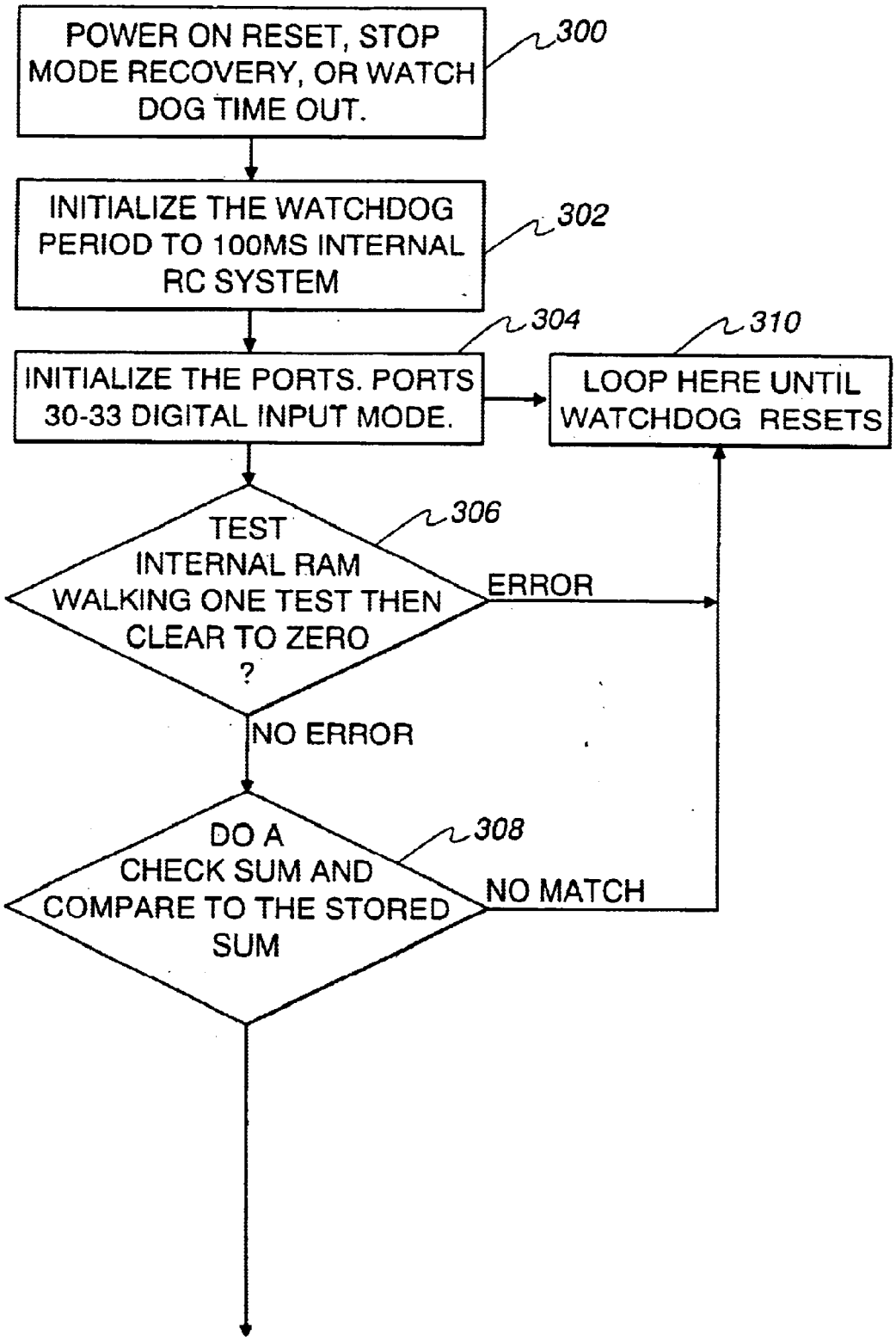
Figure 7B:
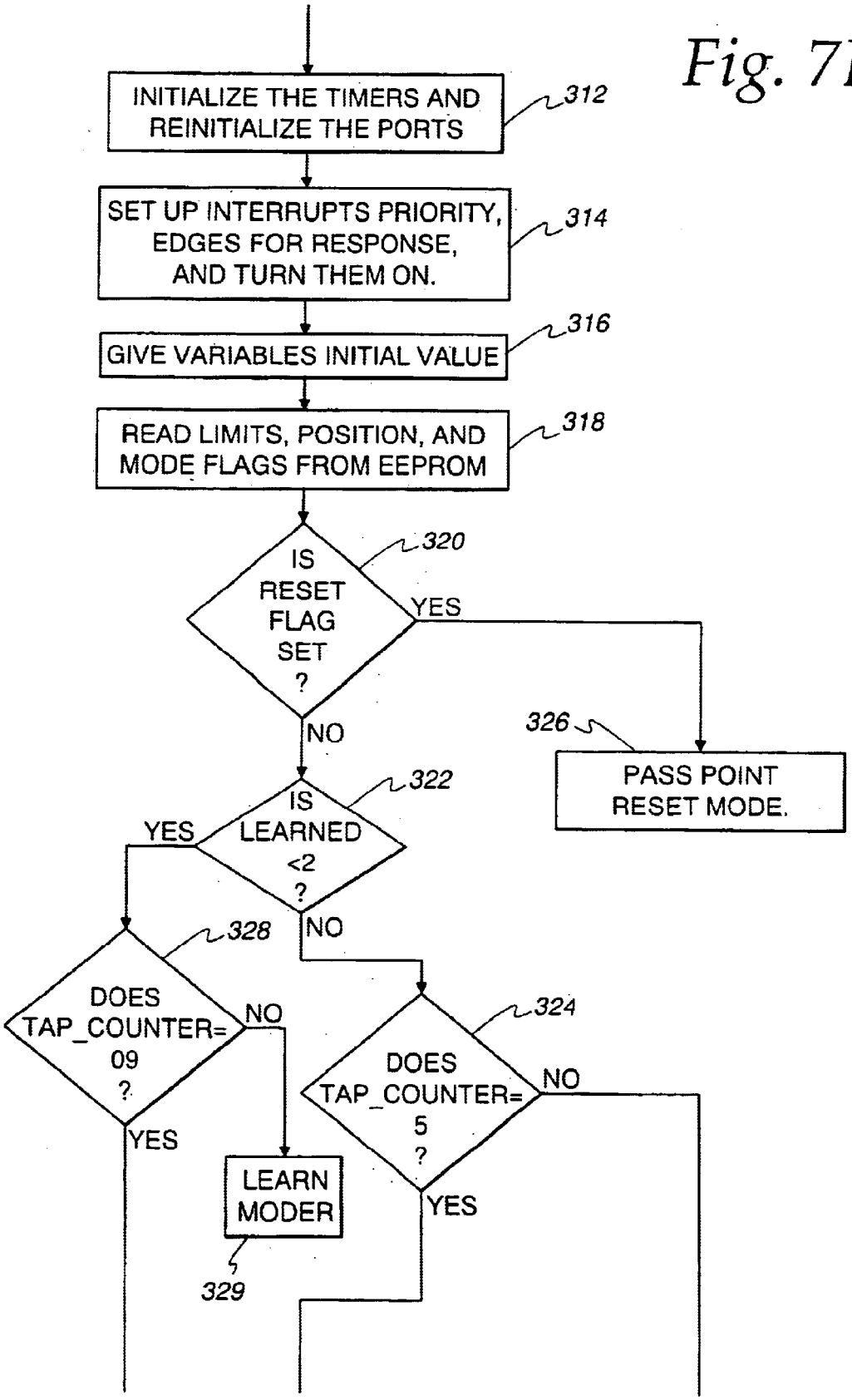

Referring to FIGS. 7A–7C, the main motor control routine running in controller 500 begins with step 300. Step 300 begins whenever power on reset or stop mode recovery is enabled, or the watch dog timer times out. In step 302, the watch dog timer period is set to 100 milliseconds. An internal RC timer circuit is used instead of a looping counter run by the controller to save processing steps. In step 304 all controller ports are initialized. Specifically, referring to FIG. 6, ports or pins P30 (input from wheel 31 in the absolute position detector 124), P31 (input from the clock wheel in the absolute position detector 124) and P33 (input from wheel 32 in the absolute position detector 124). Absolute position detector 124 provides a signal which is. indicative of the absolute position of the shutter in all its travel between limits. If a pass point assembly is utilized instead of an absolute position detector, the ports initialized would receive signals pertaining to whether the pass point had been passed, whether the shutter was above or below the pass point and information about RPM pulse.

In step 306, internal RAM is tested, then cleared to zero. If there is an error in RAM, then the routine loops until the watchdog timer resets in step 310 (100 ms time out from the RC timer). If there is no error, in step 308 the routine completes a dhecksum and compares it to a stored sum. If there is no match, the routine loops until the watchdog timer resets in step 310 (100 ms time out from the RC timer). If the sums match, the routine initializes all timers and reinitializes the ports (P30, P31, P33) in step 312.

In step 314 all interrupt priorities are setup, the selected edges of the various input signals for response are initialized and all standard interrupts (RPM and Timer0) are initialized. The RPM interrupt runs every time the motor generates an RPM signal. The Timer0 interrupt checks for a pulse indication of a tap (press and release less than one half second) or command input. In step 316 all variables are set to their initial values. In step 318 the routine reads the stored limits from memory, the current position stored in memory and mode flags (indicating mode of operation, e.g., run or learn) from memory and initializes temporary registers.

In step 320 the routine checks if the reset flag is set. If yes, the routine branches to the pass point reset mode in step 326 if a pass point assembly is installed for 124. If an absolute position detector assembly is installed, step 326 would read the position in the detector and reset the values stored in memory.

If the reset flag is not set, the routine checks if the learned flag is less than 2. The learned flag stores a value indicating the learn mode has been entered. If the learned flag is greater than or equal to 2, the routine checks the value in the tap counter in step 324. The tap counter, tap_counter, is a counter which stores the number of times the counter has received pulses indicating that the user has pressed and released the input switch for the predetermined time period. If the value in the tap counter is not equal to 5 in step 324, this means the user has activated the input device to command a shutter movement and the routine branches to the normal operation loop at step 334.

If the tap counter is equal to 5, the routine stores the learned flag with the value 1 and writes the value to memory at step 336, indicating a learn mode has been entered. Then the routine branches to the learn routine at step 338.

If the learned flag is less than 2 at step 322 the routine checks if the value of the tap counter is equal to 9 at step 328. This means, in Learn mode, the Tap_Counter is read to assure that the count is not at 9 times. If the count is at 9 times, the user is putting the controller in reset mode. The Reset_Flag is set and this flag value is written to memory in step 330. Then in step 336 the routine calls the pass point reset routine in step if a pass point assembly is installed or calls the absolute position routine if that assembly is installed. If the tap counter is not equal to 9, the routine branches to learn mode at step 329.

Figure 8A:
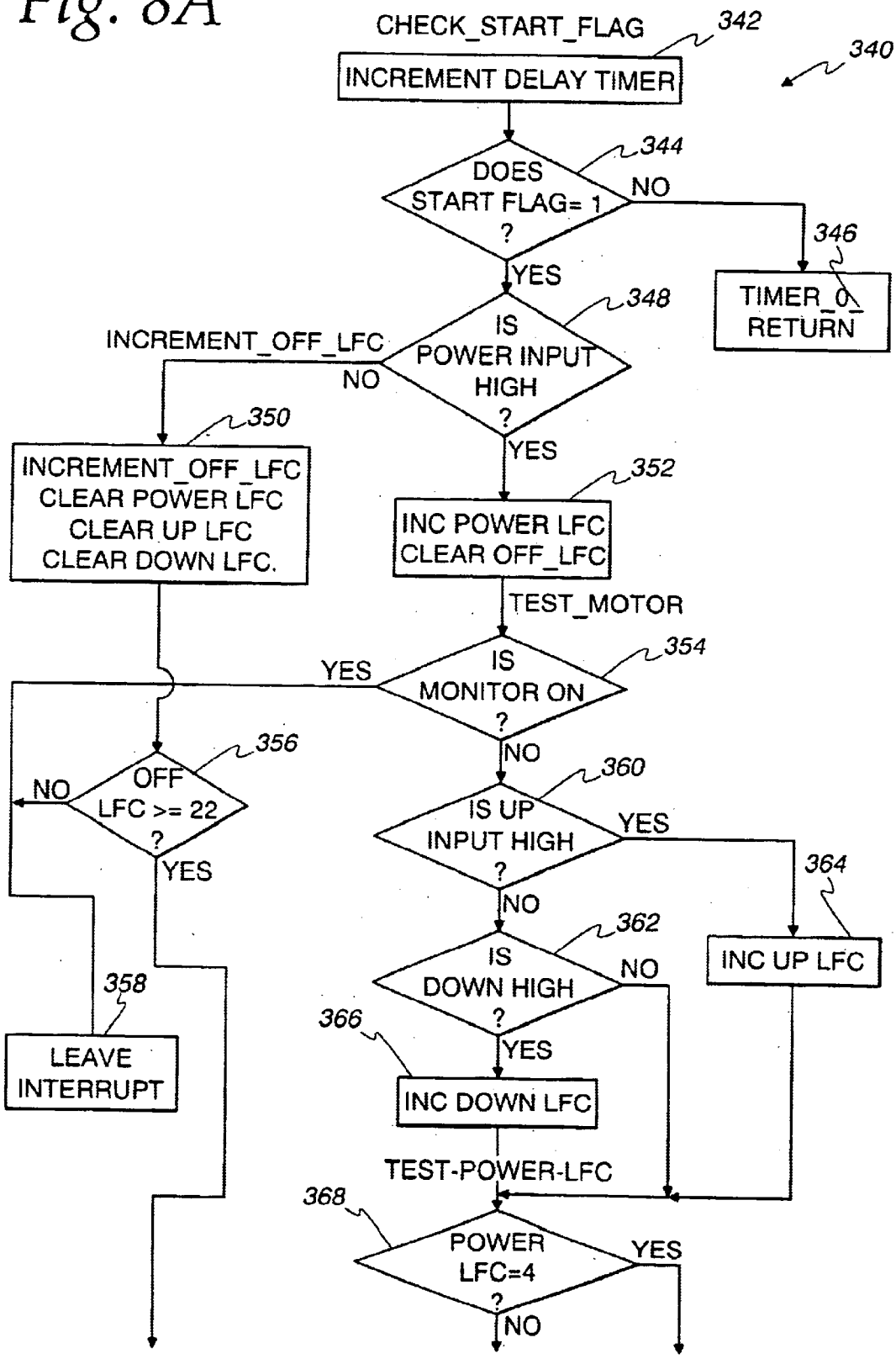
Figure 8C:
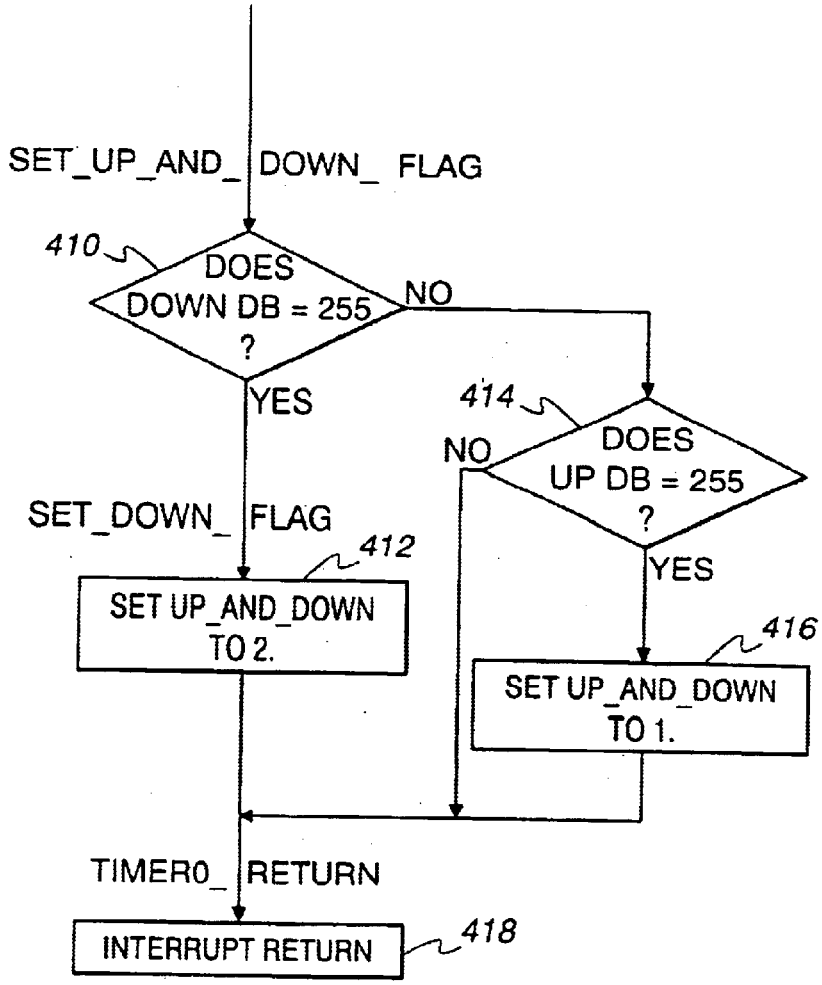
Figure 8C:
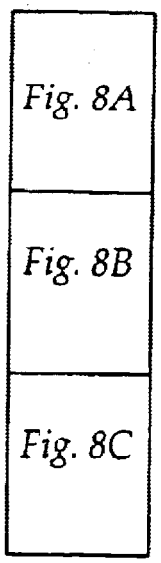

After initialization as described above, the Timer0 interrupt (or T0 interrupt) is enabled and occurs once every one millisecond. When the T0 interrupt is called each 1 ms, referring to FIGS. 8A–8C, it begins at step 342 by incrementing a Delay Timer. The Delay Timer is used to count time in the main loop or other routines. Then the routine checks if the start flag=1. If not, the routine returns at step 346. If yes, the routine checks if power input is high in step 348. If power is not high, the routine increments the OFF_LFC (the power line off sampler), which measures the time power has been removed, such as by releasing the input switch. In step 356 if the OFF_LFC is not greater than or equal to 22, the timer0 interrupt is exited at step 358. If the OFF_LFC is greater than or equal to 22, the routine clears the OFF_LFC and clears the direction debounce flags at step 370. At step 384 the routine checks if the power debounce is greater or equal to 3. If greater than or equal to 3, the routine clears the power debounce and the interrupt returns. If not, at step 388 the routine clears the power debounce, disables the Timer0 interrupt, writes the value in the tap counter to memory, then enables the timer0 interrupt, loads the stop flag with 1 and returns to the beginning of the Timer0 interrupt.

In step 348, if power input is high, the routine increments the power line sampler and clears the OFF_LFC at step 352. Next, at step 354, the routine checks if the motor is on. If yes, the timero routine ends at step 358. If not, the routine checks if the UP input is high at step 360. If yes, the routine increments the UP_LFC and continues to step 368. If not, the routine checks at step 362 if the down input is high. If not, the routine continues to step 362. If yes, the routine increments the DOWN_LFC.

At step 368 the routine checks the value of the POWER LFC. If it is not equal to 4, it returns at step 372. Then the routine checks if the power debounce is at 22 at step 376. If yes, it branches to step 390. If not, it increments the power debounce at step 378. The routine then checks if the power debounce is at 3 in step 380. If not, it branches to step 390. If yes, the routine increments the tap counter at step 382 and continues to step 390.

At step 390 the routine checks if the UP_LFC (the up direction sampler) is greater than or equal to 4. If not, the routine checks if the DOWN_LFC is greater than or equal to 4 at step 392. If not, the routine branches to step 410. If yes, the routine checks if the DOWN_DB is at 255 in step 394. If yes, the routine branches to step 410. If not, the routine clears the UP debouncer and decrements the down debouncer in step 398. Then the routine checks if the down debouncer is at 22 in step 4006. If not the routine branches to step 410. If yes, the routine sets the DOWN_DB to 255 and clears the TAP_CNTR. This indicates the user has pressed the down or close switch long enough to enable a movement command.

If the UP LFC is greater than or equal to 4, the routine checks if the UP DB is at 255 at step 396. If yes, indicating the user has pressed the up or open switch long enough to enable a movement command, the routine branches to step 410. If not, the routine clears the down debouncer and increments the up debouncer at step 400. At step 402 the routine checks if the UP DB is at 4. If not, the routine branches to step 410. If yes, the routine sets the UP DB to 255 and clears the tap counter at step 404. At step 410 the routine checks if the DOWN DB=255. If not, the routine checks if the UP DB=255 at step 414. If yes, the routine sets the UP_AND_DOWN flag to 1 at step 416 and returns at step 418. If the DOWN DB=255, the routine sets the UP_AND_DOWN flag to 2 at step 412 and returns at step 418. The UP_AND_DOWN flag is used to keep track of which direction is being requested for travel. UP is 1; DOWN is 2.

As will be appreciated from studying the description and appended drawings, the present invention may be directed to operator systems for movable barriers of many types, such as fences, gates, overhead garage doors, and the like.

While there has been illustrated and described a particular embodiment of the present invention, it will be appreciated that numerous multiple embodiments will occur to those skilled in the art, and it is intended in the appended claims to cover all those changes and modifications which followed in the true spirit and scope of the present invention.

What is claimed is:

1. A movable barrier operator, comprising:

a motor;

a transmission connected to the motor to be driven thereby and to the movable barrier to be moved;

a control unit having a first input device and a second input device for providing first and second input commands, respectively;

a controller, responsive to activation of the first input device for a first period of time for commanding the motor to operate in a first direction, responsive to activation of the second input device for a second period of time, for commanding the motor to operate in a second direction, and responsive to at least two activations of one of the input devices, wherein each activation is within a defined period of time and has a duration less than the first period of time and the second period of time, for enabling a learn mode.

2. The movable barrier operator of claim 1, wherein the control unit couples AC power to the motor upon activation of the first input device and the second input device.

3. The movable barrier operator of claim 1, wherein the controller, responsive to an activation within a defined period of time and having a duration less than the first period of time and the second period of time, stores a count of the activation.

4. The movable barrier operator of claim 3, wherein the controller, responsive to an activation of the first period of time or the second period of time, clears the count.

5. The movable barrier operator of claim 1, wherein the controller, responsive to at least three activations of one of the input devices, wherein each activation is within a defined period of time and has a duration less than the first period of time and the second period of time, for enabling a reset mode.

6. The movable barrier operator of claim 1, wherein the controller, responsive to at least three activations of one of the input devices, wherein each activation is within a defined period of time and has a duration less than the first period of time and the second period of time, for enabling a group control mode.

7. The movable barrier operator of claim 1, wherein the controller, responsive to at least three activations of one of the input devices, wherein each activation is within a defined period of time and has a duration less than the first period of time and the second period of time, for enabling a lock mode.

8. The movable barrier operator of claim 1, wherein the controller, responsive to at least three activations of one of the input devices, wherein each activation is within a defined period of time and has a duration less than the first period of time and the second period of time, for enabling a clear memory mode.

9. A movable barrier operator, comprising:

a motor;

a transmission connected to the motor to be driven thereby and to the movable barrier to be moved;

a wall control unit having a first input device and a second input device for providing first and second input commands, respectively;

a controller, responsive to activation of the first input device for a delay of at least one half second, for commanding the motor to operate in a first direction, responsive to activation of the second input device for a delay of at least one half second, for commanding the motor to operate in a second direction, and responsive to seven consecutive activations of one of the input devices, wherein each activation is within a defined period of time and has a duration less than one half second, for enabling a learn mode.

10. The movable barrier operator of claim 9, further comprising a counter for storing a count of each activation that is within three hundred milliseconds of another activation and is for a delay less than one half second.

11. The movable barrier operator of claim 10, wherein the controller, responsive to an activation of one half second or more, clears the counter.

12. The movable barrier operator of claim 9, wherein the controller, responsive to seven consecutive activations of one of the input devices, wherein each activation is within three hundred milliseconds of another activation and is for a delay less than one half second, for enabling a reset mode.

13. The movable barrier operator of claim 9, wherein the controller, responsive to five consecutive activations of one of the input devices, wherein each activation is within three hundred milliseconds of another activation and is for a delay less than one half second, for enabling a group control mode.

14. The movable barrier operator of claim 9, wherein the controller, responsive to twenty consecutive activations of one of the input devices, wherein each activation is within three hundred milliseconds of another activation and is for a delay less than one half second, for enabling a lock mode.

15. The movable barrier operator of claim 9, wherein the controller, responsive to fifty consecutive activations of one of the input devices, wherein each activation is within three hundred milliseconds of another activation and is for a delay less than one half second, for enabling a clear memory mode.

16. A method of programming a controller for a movable barrier operator, comprising:

detecting activation of an input device;

measuring the period of time of the activation of the input device;

changing a count if the measured activation time period is less than a predetermined value and within a defined period of time;

enabling a learn mode when the count on a counter is equal to a predetermined value; and activating a motor to move the barrier if the measured period of time is greater than the predetermined value.

17. The method of claim 16, further comprising the step of clearing the counter when the measured activation time period is more than the predetermined value.

18. The method of claim 17, wherein the predetermined value of the count is seven, the predetermined value of activation time period is one half second, and the defined period of time is within three hundred milliseconds of another activation.

19. The method of claim 16, further comprising the step of enabling a reset mode when the count is seven, the predetermined value of activation time period is one half second, and the defined period of time is within three hundred milliseconds of another activation.

20. The method of claim 16, further comprising the step of enabling a group control mode when the count is five, the predetermined value of activation time period is one half second, and the defined period of time is within three hundred milliseconds of another activation.

21. The method of claim 16, further comprising the step of enabling a lock mode when the count is twenty, the predetermined value of activation time period is one half second, and the defined period of time is within three hundred milliseconds of another activation.

22. The method of claim 16, further comprising the step of enabling a clear memory mode when the count is fifty, the predetermined value of activation time period is one half second, and the defined period of time is within three hundred milliseconds of another activation.

23. A method of operating a controller for a movable barrier operator, comprising:

providing a power line;

using said power line as a binary data generator;

supplying a controller capable of monitoring and decoding said binary data, wherein power on and off states serve as binary ones and zeros; and performing a mode of operation corresponding to the decoded binary data received.

24. The method of claim 23, wherein the mode of operation corresponding to the decoded binary data is a learn mode.

25. The method of claim 23, wherein the mode of operation corresponding to the decoded binary data is a reset mode.

26. The method of claim 23, wherein the mode of operation corresponding to the decoded binary data is a group control mode.

27. The method of claim 23, wherein the mode of operation corresponding to the decoded binary data is a lock mode.

28. The method of claim 23, wherein the mode of operation corresponding to the decoded binary data is a memory clear mode.

* * * * *